US010036586B2

(12) United States Patent
Yang

(10) Patent No.: US 10,036,586 B2
(45) Date of Patent: Jul. 31, 2018

(54) REFRIGERATOR

(71) Applicant: Dongbu Daewoo Electronics Corporation, Seoul (KR)

(72) Inventor: Sung Jin Yang, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 0 days.

(21) Appl. No.: 15/456,144

(22) Filed: Mar. 10, 2017

(65) Prior Publication Data

US 2017/0292754 A1 Oct. 12, 2017

(30) Foreign Application Priority Data

Apr. 8, 2016 (KR) ..... 10-2016-0043553

(51) Int. Cl.

| | |
|---|---|
| ***F25C 5/04*** | (2006.01) |
| ***F25C 5/18*** | (2018.01) |
| ***F25C 5/182*** | (2018.01) |
| ***F25C 5/20*** | (2018.01) |

(52) U.S. Cl.

CPC ..... *F25C 5/046* (2013.01); *F25C 5/182* (2013.01); *F25C 5/22* (2018.01); *F25C 2400/10* (2013.01)

(58) Field of Classification Search

CPC .. F25C 5/046; F25C 5/22; F25C 5/182; F25C 2400/10; F25C 5/005; F25C 5/02; F25C 5/18; F25C 5/185; F25C 5/04; F25C 5/24; F25C 1/04; F25C 2/12; F25C 2700/10; F25D 11/02; F25D 23/04; F25D 17/065; F25D 23/028; F25D 23/065

USPC ..... 62/320

See application file for complete search history.

(56) References Cited

U.S. PATENT DOCUMENTS

| | | | | |
|---|---|---|---|---|
| 8,011,202 | B2 * | 9/2011 | Kim | F25C 5/22 62/344 |
| 2005/0210909 | A1 * | 9/2005 | Kim | F25D 17/065 62/340 |
| 2006/0266059 | A1 * | 11/2006 | Wetekamp | F25C 5/22 62/187 |
| 2008/0156021 | A1 * | 7/2008 | Shin | F25D 17/065 62/340 |
| 2011/0094254 | A1 * | 4/2011 | Kim | F25C 1/04 62/344 |
| 2012/0023997 | A1 * | 2/2012 | Jung | F25D 17/065 62/340 |
| 2013/0167575 | A1 * | 7/2013 | Hong | F25C 1/00 62/344 |
| 2013/0174596 | A1 * | 7/2013 | Kim | F25C 1/04 62/320 |
| 2013/0305763 | A1 * | 11/2013 | Nuss | F25C 5/046 62/320 |
| 2014/0345313 | A1 * | 11/2014 | Jeong | F25C 5/046 62/320 |

(Continued)

FOREIGN PATENT DOCUMENTS

| | | |
|---|---|---|
| JP | 59-143284 | 8/1984 |
| KR | 10-2013-0081136 | 7/2013 |

*Primary Examiner* — Mohammad M Ali

(57) ABSTRACT

A refrigerator including an ice maker and cutters for crushing ice produced from the ice maker. The cutters include fixed cutters and rotational cutters. Through holes are formed on the cutters to facilitate cold air flow to pass through the cutters and into the ice crushing space. The rotational cutters can rotate in one direction to crush the ice, and can rotate in another direction to leave the ice uncrushed.

20 Claims, 6 Drawing Sheets

(56) References Cited

U.S. PATENT DOCUMENTS

2015/0135739 A1* 5/2015 Choo ..... F25C 5/182
62/66

* cited by examiner

REFRIGERATOR

CROSS-REFERENCE TO RELATED APPLICATIONS

This application is based on and claims priority from Korean Patent Application No. 10-2016-0043553, filed on Apr. 8, 2016, the disclosure of which is incorporated herein in its entirety by reference for all purposes.

TECHNICAL FIELD

The present disclosure relates to refrigerators, and more particularly, to ice makers in the refrigerators.

BACKGROUND OF THE INVENTION

A refrigerator is an appliance used for storing food at a low temperature and may be configured to store food (or other items) in a frozen state or a refrigerated state depending on the type of food to be stored. The inside of the refrigerator is cooled by circulating cold air that can be continuously generated through a heat exchange process by using a refrigerant. During operation, the refrigerant goes through repetitive cycles of compression, condensation, expansion and evaporation. The cold air supplied into the refrigerator is uniformly distributed by convection. Accordingly, the items placed in the refrigerator can be stored at a desired low temperature.

A main body of the refrigerator may have a rectangular parallel-piped shape with an open front surface. Typically, the main body encloses a refrigeration compartment (or refrigeration compartment) and freezer, each with its own door. The refrigerator may include a plurality of drawers, shelves, vegetable compartments and the like for sorting and storing different types of objects.

Conventionally, top mount type refrigerators were popular, with a freezer positioned at an upper side and a refrigeration compartment positioned at a lower side. Recently, bottom freezer type refrigerators have been developed, where the freezer is located at the lower side. A bottom freezer type refrigerator provides the advantage that a user can conveniently access the refrigerator in general. However, a user often needs to lower down or bend down to access the freezer, e.g., for taking ice from it.

Some bottom freezer type refrigerators have an ice dispenser located at the refrigeration compartment disposed at the upper side of the refrigerator. In such a refrigerator, the ice maker used to make ice may be disposed on the refrigeration compartment door or inside the refrigeration compartment.

Ice made by the ice maker may be stored in an ice storage space and transferred to an ice crushing space through a pathway and moved by rotation of an auger. In the ice crushing space, ice can be crushed by a plurality of rotational cutters and a fixed cutter. The rotational cutters are spaced apart from each other at a regular interval. This can reduce the load that may be generated during an ice crushing operation. However, in this configuration, the flow of cold air from the pathway is undesirably disturbed.

Patent Document 1: Korean Patent No. 10-2012-0080722 (Published on Jul. 18, 2012)

SUMMARY OF THE INVENTION

One embodiment of the present disclosure provides a refrigerator having an ice crushing space for efficient flow of cold air.

According to one embodiment of the present disclosure, a refrigerator includes: an ice maker, where water is converted to ice in the ice maker by an air flow supplied from an evaporator of the refrigerator; a rotational cutter including a first cold air through hole and configured to crush ice that is supplied from the ice maker, where the rotational cutter is operable to rotate; and a fixed cutter including a second cold air through hole and configured to press and crush the ice supplied from the ice maker, where the fixed cutter is non-rotatable.

DETAILED DESCRIPTION

Figure 1:
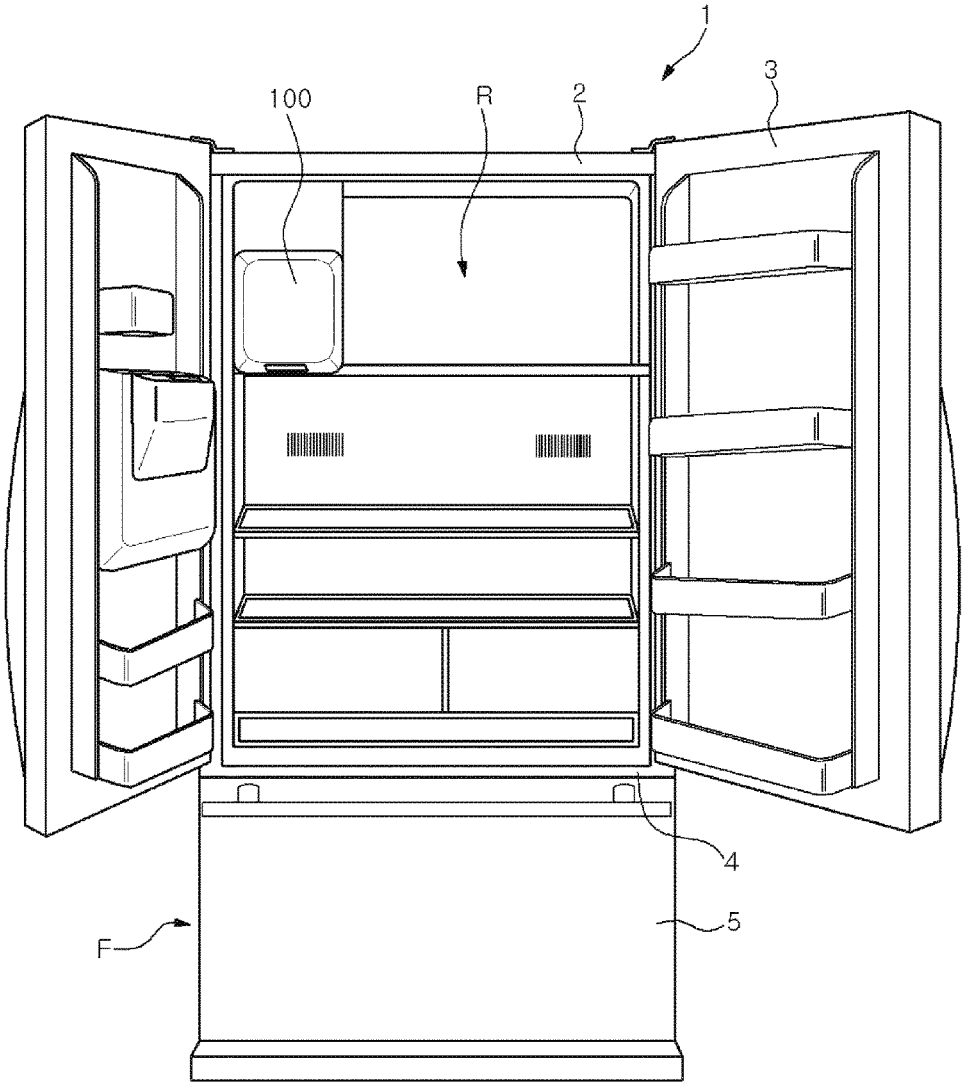
FIG. 1 is a perspective view of an exemplary refrigerator according to an embodiment of the present disclosure.

Hereinafter, configurations and operations of embodiments will be described in detail with reference to the accompanying drawings. The following description is one of various patentable aspects of the disclosure and may form a part of the detailed description of the disclosure.

However, in describing the disclosure, detailed descriptions of known configurations or functions that may make the disclosure obscure may be omitted.

The present disclosure may be variously modified and may include various embodiments. Specific embodiments will be exemplarily illustrated in the drawings and described in the detailed description of the embodiments. However, it should be understood that they are not intended to limit the disclosure to specific embodiments but rather to cover all modifications, similarities, and alternatives which are included in the spirit and scope of the disclosure.

The terms used herein, including ordinal numbers such as "first" and "second" may be used to describe, and not to limit, various components. The terms simply distinguish the components from one another.

When it is said that a component is "connected" or "linked" to another component, it should be understood that the former component may be directly connected or linked to the latter component or a third component may be interposed between the two components.

Specific terms used in the present application are used simply to describe specific embodiments without limiting the disclosure. An expression used in the singular encompasses the expression of the plural, unless it has a clearly different meaning in the context.

Figure 2:
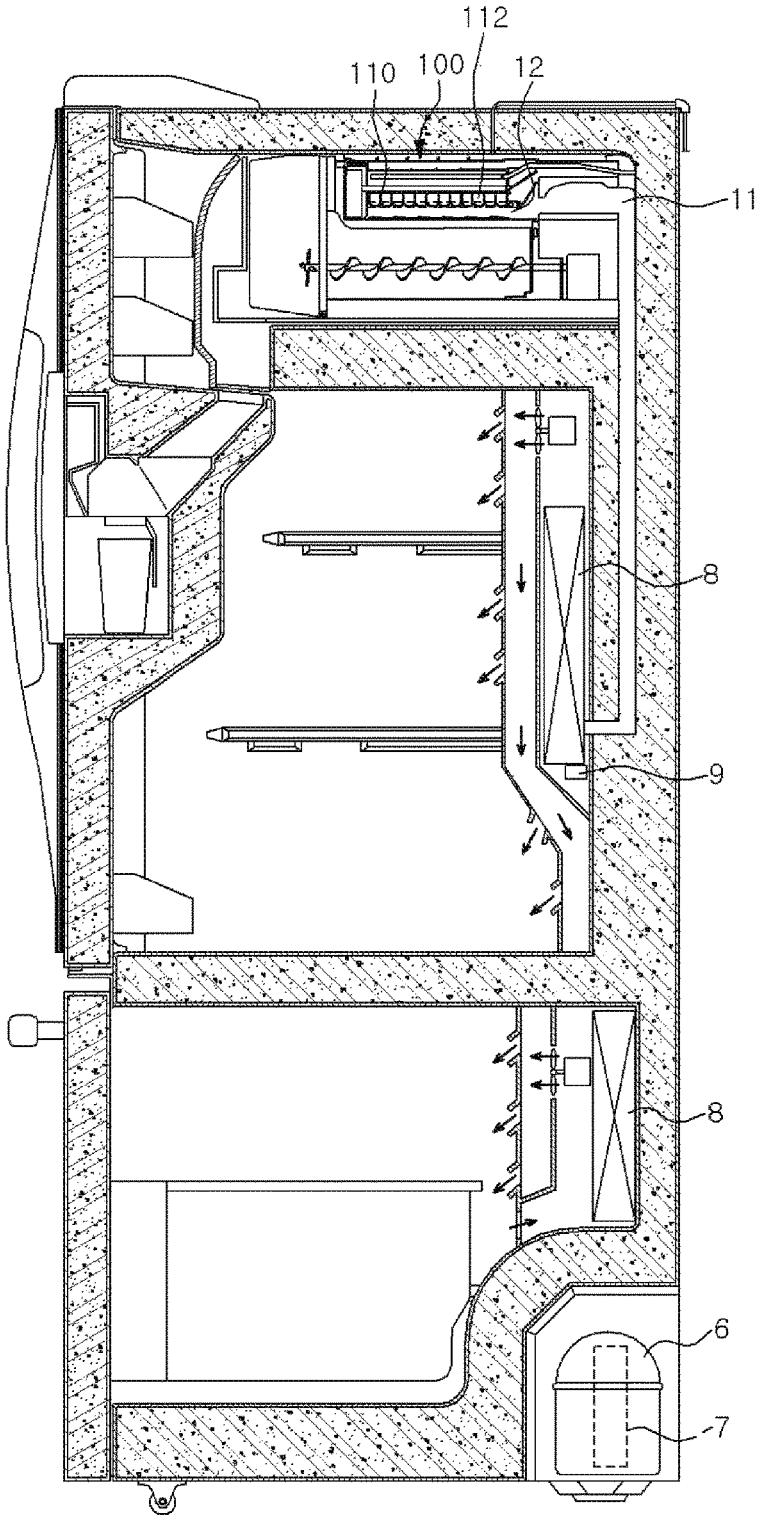
FIG. 2 is a side view of the exemplary refrigerator in FIG. 1 according to an embodiment of the present disclosure.

FIG. 1 is a perspective view of an exemplary refrigerator according to an embodiment of the present disclosure. FIG. 2 is a side view of the exemplary refrigerator in FIG. 1.

Referring to FIGS. 1 and 2, a refrigerator 1 according to an embodiment may include: a main body 2 forming an outer body and having a storage space (e.g., for food); a barrier 4 for dividing the storage space in the main body 2 into a refrigeration compartment R disposed at an upper side and a freezer F disposed at a lower side; rotatable refrigeration compartment doors 3, disposed at both front edges of the main body 2, for sealing the refrigeration compartment R; a freezer door 5 for sealing the refrigeration compartment F; and an ice maker 100 for making ice by using cold air circulating in the refrigerator. In the present embodiment, the ice maker 100 is disposed at an upper side of the refrigeration compartment R. However, this is merely exemplary. The ice maker 100 may be disposed at any different suitable location in the refrigeration compartment R, e.g., on the refrigeration compartment doors 3 or the like.

Generally, a refrigeration cycle of the refrigerator 1 includes the processes of compression, condensation, expansion and evaporation. Cold air is generated while the refrigeration cycle is repeated. An evaporator 8 can perform a refrigeration process for producing and supplying cold air for the refrigerator 1.

More specifically, a refrigerant in a low-temperature and low-pressure gaseous state is compressed into a refrigerant in a high-temperature and high-pressure gaseous state by a compressor 6. Then, the refrigerant in the high-temperature and high-pressure gaseous state is condensed into a refrigerant in a high-temperature and high-pressure liquid state by a condenser 7. Next, the refrigerant in the high-temperature and high-pressure liquid state is expanded into a refrigerant in a low-temperature and low-pressure liquid state by an expansion device (not shown). Thereafter, the refrigerant in the low-temperature and low-pressure liquid state is transferred to the evaporator 8. In the evaporator 8, the refrigerant in the low-temperature and low-pressure liquid state absorbs heat from surrounding air and evaporates. With heat transferred to the refrigerant, air in the vicinity of the evaporator 8 is cooled down and becomes cold air.

Since the surface temperature of the evaporator 8 is usually lower than the temperature inside the refrigerator, condensate water may accumulate on the surface of the evaporator 8 during the heat exchange between the refrigerant and the air circulating in the refrigerator. The condensate water can freeze on the surface of the evaporator 8 and turn into frost. As frost accumulates on the evaporator 8, the amount of heat that can be absorbed from the air by the evaporator 8 unfortunately decreases considerably. As a result, heat exchange efficiency of the evaporator 8 decreases remarkably.

To remove frost on the evaporator 8, a defrosting operation is usually performed for melting the frost, which typically requires a shutdown of the cooling process. A defrosting heater 9 for performing the defrosting operation may be disposed below the evaporator 8.

In a bottom freezer type refrigerator with the ice maker 100 installed at the refrigeration compartment door 3, cold air supplied to the freezer F flows toward the ice maker 100 through a cold air duct 11 and freezes water contained in the ice maker 100, thereby producing ice.

In the ice maker 100, a cold air passage 12 may be formed below an ice making tray 110 so that the cold air supplied from the cold air duct 11 flows through a bottom surface of the ice making tray 110 that contains water.

Cold air flowing through the cold air passage 12 exchanges heat with the ice making tray 110. Accordingly, water stored in an ice making space 112 of the ice making tray 110 freezes and becomes ice. Ice can be transferred to an ice storage space 200 disposed below the ice making tray 110.

Further, ice stored in the ice storage space 200 can be moved to an ice crushing space 300 by an auger 400 and crushed by the rotational cutters 500 and the fixed cutters 600.

Figure 3:
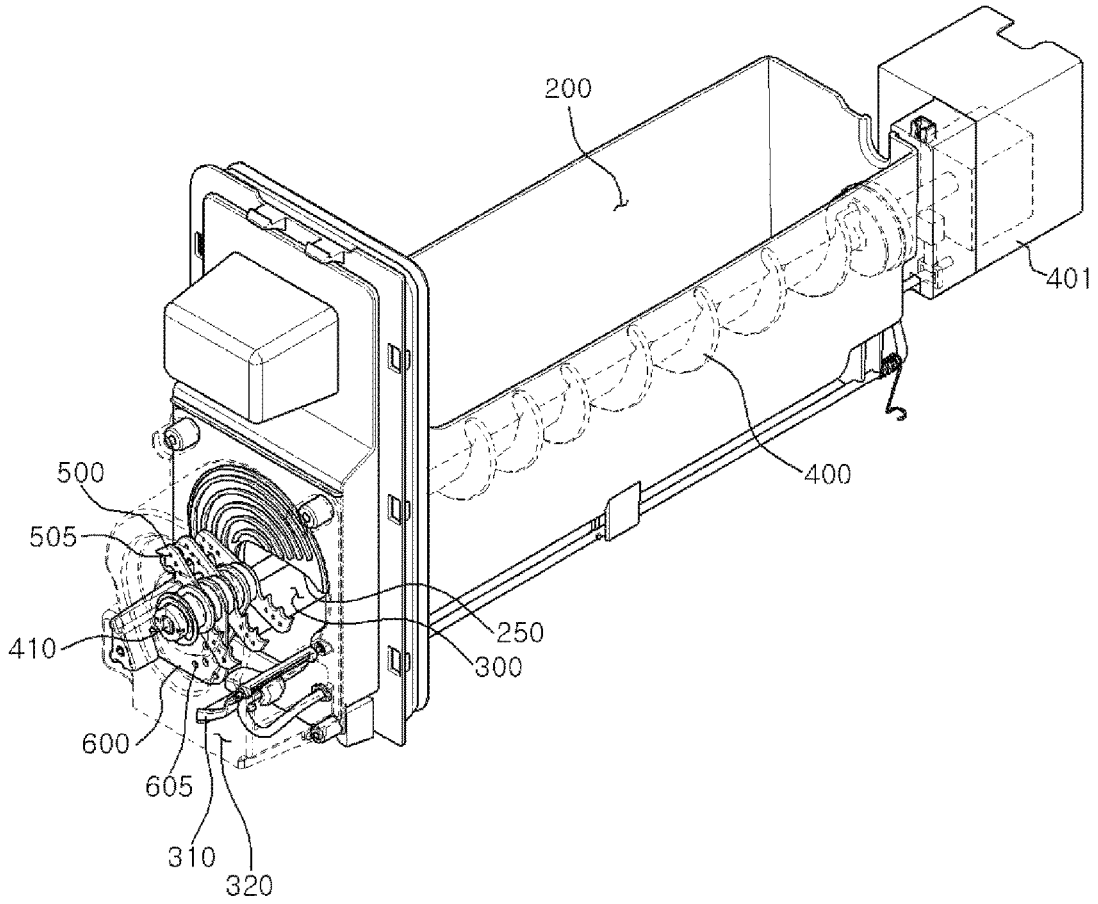
FIG. 3 is a perspective view showing the configuration of an exemplary ice storage space and an exemplary ice crushing space of the refrigerator in FIG. 1 according to an embodiment of the present disclosure.
Figure 4:
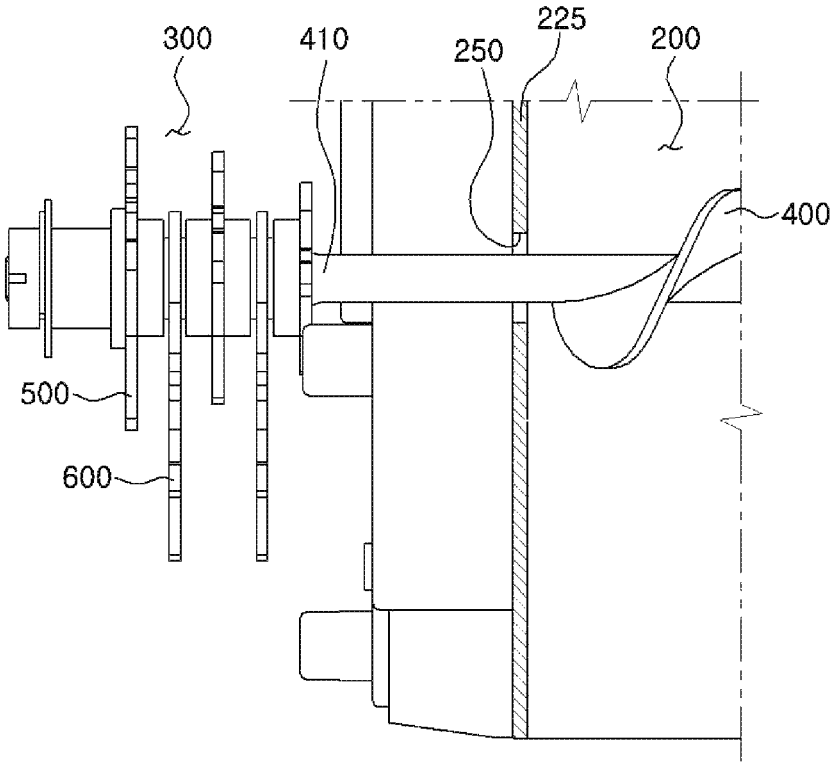
FIG. 4 is a side view showing the configuration of the exemplary ice storage space and the exemplary ice crushing space of the refrigerator in FIG. 1 according to an embodiment of the present disclosure.
Figure 5:
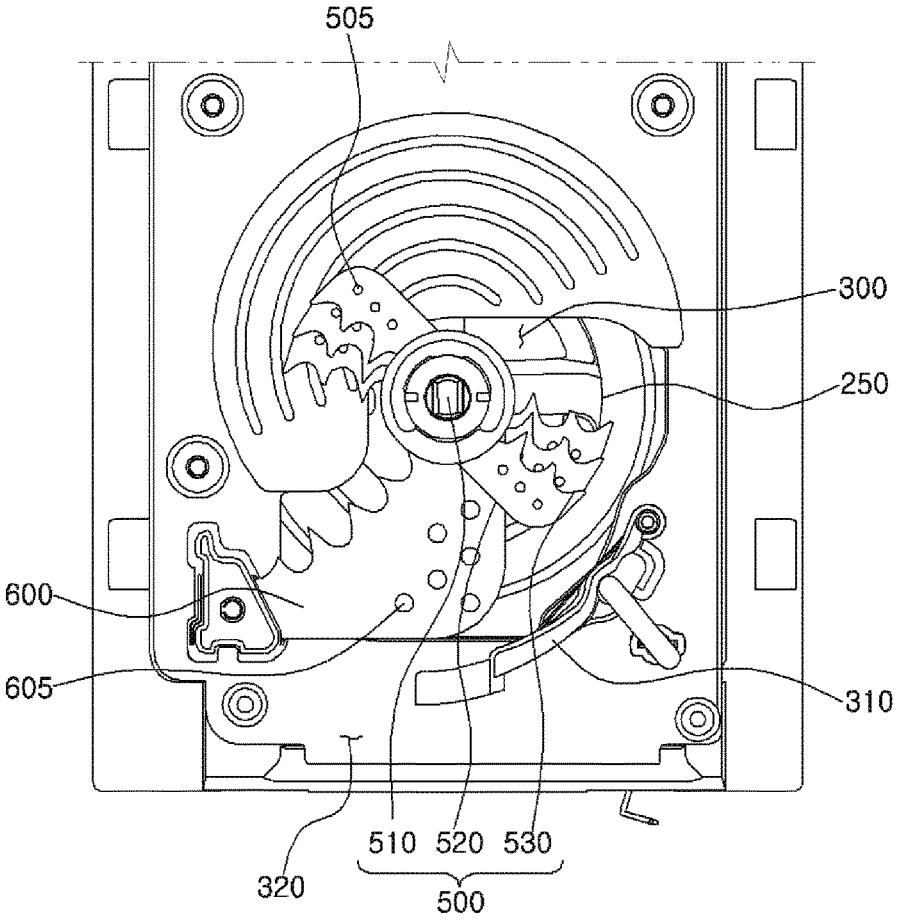
FIG. 5 is a front view showing the configuration of exemplary rotational cutters and an exemplary fixed cutter according to an embodiment of the present disclosure.
Figure 6:
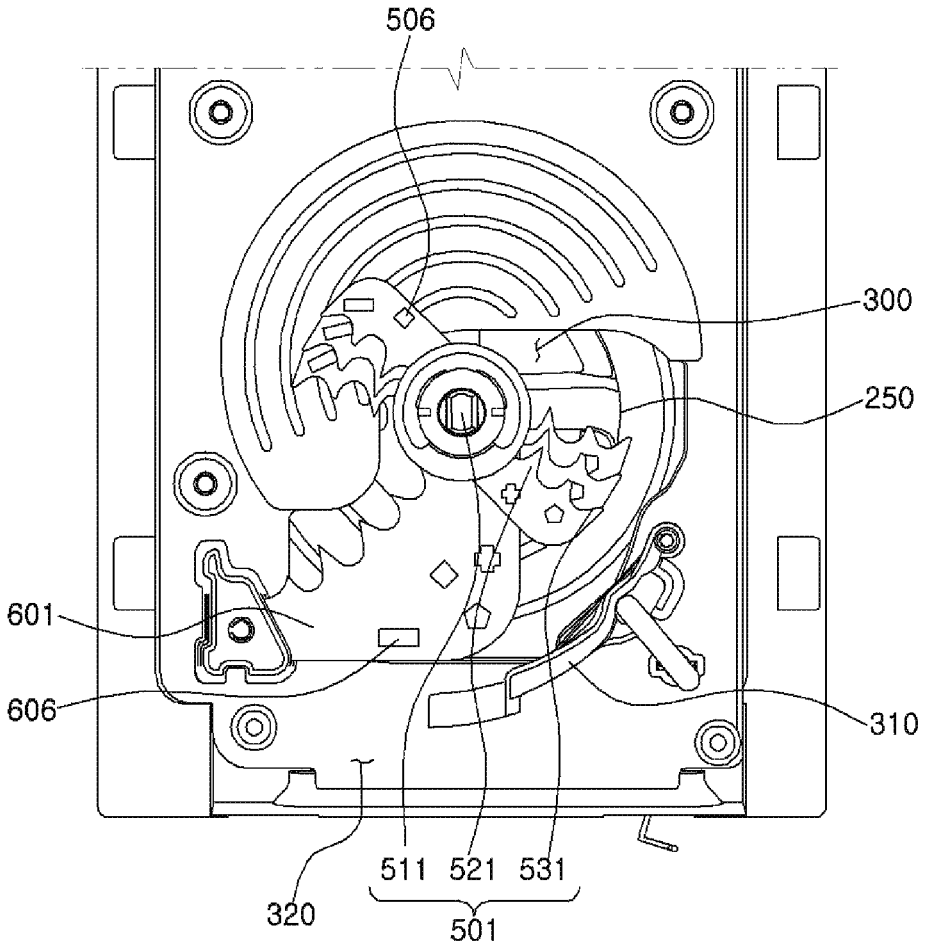
FIG. 6 is a front view showing the configuration of exemplary rotational cutters and an exemplary fixed cutter according to an embodiment of the present disclosure.

FIG. 3 is a perspective view showing the configuration of an exemplary ice storage space and an exemplary ice crushing space of the refrigerator in FIG. 1 according to an embodiment of the present disclosure. FIG. 4 is a side view showing the configuration of the exemplary ice storage space and the exemplary ice crushing space of the refrigerator in FIG. 1 according to an embodiment of the present disclosure. FIG. 5 is a front view showing the configuration of exemplary rotational cutters and an exemplary fixed cutter according to an embodiment of the present disclosure. FIG. 6 is a front view showing the configuration of exemplary rotational cutters and an exemplary fixed cutter according to an embodiment of the present disclosure.

Referring to FIGS. 3 to 6, the exemplary refrigerator 1 may include: the ice maker 100 for making ice using cold air; the ice storage space 200 for storing ice made by the ice maker 100; the ice crushing space 300, formed in front of the ice storage space 200, where the ice can be crushed; and the auger 400 for moving ice stored in the ice storage space 200 to the ice crushing space 300. The refrigerator 1 may also include the rotational cutters 500, each having one or more "first" cold air through holes 505 through which cold air can pass. The rotational cutters 500 can rotate forward or backward as being coupled to a rotation axis 410 of the auger 400. The rotational cutters 500 can crush ice and discharge uncrushed ice depending on a rotation direction.

The refrigerator 1 may also include the fixed cutters 600, each having one or more "second" cold air through holes 605 through which cold air can pass. The fixed cutters 600 are positioned to face an ice crushing direction of the rotational cutters 500, and can press and crush ice together with the rotational cutters 500.

The ice maker 100 can make ice using cold air supplied from the evaporator 8. The ice storage space 200 can store ice generated by the ice maker 100.

The ice crushing space 300 may be disposed in front of the ice storage space 200 and separated from the ice storage space 200 by a partition portion 225. Ice generated by the ice maker 100 can be moved to the ice crushing space 300 and crushed therein.

Therefore, the rotational cutters 400 and the fixed cutters 600 may be disposed in the ice crushing space 300. A discharge port 320 may be disposed below the ice crushing space 300 through which ice (crushed in the ice crushing space 300 or uncrushed) can be discharged. The opening of the discharge port 320 may be controlled by an opening/closing member 310.

The auger 400 can transfer ice from the ice storage space 200 to the ice crushing space 300. The auger 400 can be driven by an auger motor 401 disposed at a rear side of the ice storage space 200. More specifically, when the auger 400 is activated by the auger motor 401, ice can be moved from the ice storage space 200 to the ice crushing space 300 through the communication portion 250 formed at the partition portion 225. Since cold air can flow into the ice crushing space 300 through the communication portion 250, the temperature in the ice crushing space 300 can be maintained at a level suitable for ice crushing.

The rotational cutters 500 can rotate forward or backward while being coupled to the rotation axis 410 of the auger 400. The rotational cutters 500 can selectively crush the ice depending on its rotation direction. For example, when the rotational cutters 500 rotate forward, ice is crushed between the rotational cutters 500 and the fixed cutters 600 and the crushed ice is discharged through the discharge port 320. When the rotational cutters 500 rotate backward, ice can be discharged through the discharge port 320 without being crushed.

The rotational cutters 500 may be spaced apart from each other, e.g., at a regular interval, to reduce the load that may be generated during the ice crushing operation.

However, with the rotational cutters 500 being spaced apart from each other at a regular interval, the flow of cold air into the ice crushing space 300 may be obstructed or disturbed. Thus cold air can be trapped in the ice crushing space 300 and this may causes melting of the crushed ice pieces that remains on the surfaces of the rotational cutters 500. Water from these surfaces of the rotational cutters 500 can leak to a dispenser (not shown) which can impair the reliability of the refrigerator 1. Further, the rotation of the rotational cutters 500 may be restricted and, thus, an ice crushing speed may be decreased. Moreover, if the rotational cutters 500 are not maintained in a clean state, then it will difficult to store the ice for a long time in the ice storage space 200.

To solve these problems, the rotational cutter 500 according to an embodiment of the present disclosure may include: a central portion 510 through which the rotation axis 410 of the auger 400 penetrates; an extension portion 520 extending from the central portion 510 in a radial direction; and a plurality of crushing portions 530, disposed at one side of the extension portion 520, for crushing the ice during rotation, and having the first cold air through holes 505.

The rotation axis 410 of the auger 400 penetrates through the central portion 510. Further, the central portion 510 may be shaped, e.g., an elongated hole shape, so that the rotation of the auger 400 can be transferred.

The extension portion 520 may have one or more first cold air through holes 505. Cold air can flow into the ice crushing space 300 through the communication portion 250, and can pass through the first cold air through holes 505. Each of the first cold air through holes 505 may be circular for instance. However, the present disclosure is not limited by the shape and the number of the first cold air through holes 505. As shown in FIG. 6, a first cold air through hole 506 having a polygonal shape may be formed on an extension portion 521 of a rotational cutter 501.

More specifically, the crushing portion 530 capable of crushing ice is disposed at a first side of the extension portion 520. The second side of the extension portion 520 (e.g., the opposite side of the crushing portion 530) may be unsharpened so that the ice can be moved without being crushed.

The crushing portion 530 may have a saw-toothed shape for instance. However, the present disclosure is not limited by the shape of the crushing portion 530.

The fixed cutters 600 may be disposed in the ice crushing direction of the rotational cutters 500. More specifically, the first end portion of the fixed cutter 600 may be inserted into the rotation axis 410 and the second end portion of the fixed cutter 600 may be disposed below the rotation axis 410 of the auger 400.

The number of the fixed cutters 600 may be smaller than the number of the rotational cutters 500. The fixed cutters 600 may be disposed between the rotational cutters 500. The fixed cutters 600 can press and crush the ice in conjunction with the rotational cutters 500.

The fixed cutters 600 may have one or more second cold air through holes 605 through which the cold air can pass. Cold air that flows into the ice crushing space 300 through the communication portion (or pathway) 250 can pass through the second cold air through holes 605 and the first cold air through holes 505 formed at the rotational cutters 500. The fixed cutters 600 may have a larger area than the rotational cutter 500. The number of second cold air through holes 605 may be greater than that of the first cold air through holes 505. However, in some other embodiments, the number of the second cold air through holes 605 may not be greater than that of the first cold air through holes 505. The second cold air through holes 605 may have substantially the same shape as the first cold air through holes 505, e.g., circular. However, it is merely exemplary. In some other embodiments, the fixed cutter 601 may have second cold air through holes 606 formed in a polygonal shape as shown in FIG. 6, or in any other suitable shape.

When a user pushes an ice dispensing button (not shown) through the dispenser (not shown), the auger 400 is driven by the auger motor 401 and ice stored in the ice storage space 200 is moved to the ice crushing space 300.

Ice moved to the ice crushing space 300 is placed between the rotation cutters 500 and the fixed cutters 600. When the rotational cutters 500 rotate forward, the ice is crushed and becomes smaller ice pieces.

On the other hand, when the rotational cutters 500 rotate backward, ice moved by the rotational cutters 500 presses the opening/closing member 310. Thus, an end portion of the opening/closing member 310 pressed by the ice rotates downward, and consequently a space between the opening/closing member 310 and the rotational cutters 500 becomes wide. Accordingly, uncrushed ice is discharged to the space through the discharge port 320.

With the rotational cutters 500 separated from each other at a regular interval, the work load that may be generated during the ice crushing operation performed by the forward rotation of the rotational cutters 500 can be reduced. However, cold air flow toward the ice crushing space 300 may be obstructed.

As the flow of cold air is obstructed by the rotational cutters 500 which are separated from each other at a regular interval, cold air may be trapped in the ice crushing space 300 and this may cause melting of the crushed ice pieces remaining on the surfaces of the rotational cutters 500. As a result, rotation of the rotational cutters 500 may be restricted and the rotational cutters 500 may not be kept in a clean state.

According to the present disclosure, the rotational cutters 500 and the fixed cutters 600 have the first cold air through holes 505 and the second cold air through holes 605, respectively. Therefore, friction on the surfaces of the rotational cutters 500 during the ice crushing operation can be effectively reduced. The reduced friction can reduce the amount of crushed ice residual left on the surfaces of the rotational cutters 500. Even if there is some crushed ice residual remaining on the surfaces of the rotational cutters 500, cold air passing through the through holes 505 and 605 can maintain the residual in frozen state without melting. In addition, the rotational cutters 500 can be maintained in a clean state. This can prevent rotation of the rotational cutters 500 from being restricted due to melting of the ice residual that is attached to the rotational cutters 500. Accordingly, the reliability of the refrigerator 1 can be improved.

Moreover, as the cold air through holes 505 and 605 facilitates the cold air flow in the ice storage space 200 and the ice crushing space 300, ice can be stored in the ice storage space 200 for an extended time.

Although exemplary embodiments of the present disclosure are described above with reference to the accompanying drawings, those skilled in the art will understand that the present disclosure may be implemented in various ways without changing the necessary features or the spirit of the present disclosure.

Therefore, it should be understood that the exemplary embodiments described above are not limiting, but only an example in all respects. The scope of the present disclosure is expressed by claims below, not the detailed description, and it should be construed that all changes and modifications achieved from the meanings and scope of claims and equivalent concepts are included in the scope of the present disclosure.

From the foregoing, it will be appreciated that various embodiments of the present disclosure have been described herein for purposes of illustration, and that various modifications may be made without departing from the scope and spirit of the present disclosure. The exemplary embodiments disclosed in the specification of the present disclosure do not limit the present disclosure. The scope of the present disclosure will be interpreted by the claims below, and it will be construed that all techniques within the scope equivalent thereto belong to the scope of the present disclosure.

What is claimed is:

1. A refrigerator, comprising:

an ice maker, wherein water is converted to ice in the ice maker by an air flow supplied from an evaporator of the refrigerator to the ice maker;

a rotational cutter comprising a first cold air through hole and configured to crush ice that is supplied from the ice maker, wherein the rotational cutter is operable to rotate; and a fixed cutter comprising a second cold air through hole and configured to press and crush ice supplied from the ice maker, wherein the fixed cutter is non-rotatable.

2. The refrigerator of claim 1 further comprising an ice storage space for storing ice supplied from the ice maker.

3. The refrigerator of claim 2 further comprising an ice crushing space formed in front of the ice storage space, wherein ice supplied from the ice maker is crushed in the ice crushing space.

4. The refrigerator of claim 3 further comprising an auger configured to move ice from the ice storage space to the ice crushing space.

5. The refrigerator of claim 4, wherein the rotational cutter is coupled to a rotation axis of the auger, and wherein further the rotational cutter is configured to rotate in two directions.

6. The refrigerator of claim 5, wherein ice is crushed when the rotational cutter rotates in a first direction, and wherein ice is not crushed when the rotational cutter rotates in a second direction.

7. The refrigerator of claim 5, wherein the fixed cutter is positioned to face an ice crushing direction of the rotational cutter.

8. The refrigerator of claim 4, wherein the rotational cutter comprises:

a central portion, wherein a rotation axis of the auger penetrates the central portion;

an extension portion extending from the central portion in a radial direction; and a plurality of crushing portions disposed at a first side of the extension portion and configured to crush ice during rotation of the rotational cutter, wherein the first cold air through hole is located at the extension portion.

9. The refrigerator of claim 8, wherein the rotational cutter comprises at least two extension portions.

10. The refrigerator of claim 8, wherein a first end portion of the fixed cutter is inserted in the rotation axis of the auger, and wherein a second end portion of the fixed cutter is disposed below the rotation axis of the auger.

11. The refrigerator of claim 1, wherein the first cold air through hole and the second cold air through hole have one of a circular shape and a polygonal shape, respectively.

12. The refrigerator of claim 1, wherein the first cold air through hole and the second cold air through hole are configured to allow air flow supplied from the evaporator to pass through the rotational cutter and the fixed cutter.

13. A refrigerator comprising:

a main body;

an ice making compartment disposed in the main body, wherein water is converted to ice in ice making compartment;

an ice storage space for storing ice;

an auger configured to transfer ice from the ice storage space to an ice crushing space;

a rotational cutter comprising a first cold air through hole and configured to crush ice that is supplied from the ice maker, wherein the rotational cutter is operable to rotate; and a fixed cutter comprising a second cold air through hole and configured to crush ice that is supplied from the ice maker, wherein the fixed cutter is non-rotatable, wherein the first cold air through hole and the second cold air through hole are configured to allow air flow supplied from an evaporator of the refrigerator to pass through the rotational cutter and the fixed cutter.

14. The refrigerator of claim 13, wherein the rotational cutter is coupled to a rotation axis of the auger, and wherein the rotational cutter is configured to rotate in two directions.

15. The refrigerator of claim 14, wherein ice is crushed when the rotational cutter rotates in a first direction, and wherein ice is not crushed before being dispensed, when the rotational cutter rotates in a second direction.

16. The refrigerator of claim 15, wherein the fixed cutter is positioned to face an ice crushing direction of the rotational cutter.

17. The refrigerator of claim 14, wherein the rotational cutter comprises:

a central portion, wherein the rotation axis of the auger penetrates the central portion;

an extension portion extending from the central portion in a radial direction; and a plurality of crushing portions disposed at a first side of the extension portion and configured to crush ice during rotation of the rotational cutter, wherein the first cold air through hole is formed on the extension portion.

18. The refrigerator of claim 17, wherein the rotational cutter comprises at least two extension portions.

19. The refrigerator of claim 17, wherein a first end portion of the fixed cutter is inserted in the rotation axis of the auger, and wherein a second end portion of the fixed cutter is disposed below the rotation axis of the auger.

20. The refrigerator of claim 13, wherein the first cold air through hole and the second cold air through hole have different shapes.

* * * * *